US012320220B2

(12) United States Patent
Batarseh

(10) Patent No.: US 12,320,220 B2
(45) Date of Patent: Jun. 3, 2025

(54) LASER CLADDING FISHING TOOL

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/467,404

(22) Filed: Sep. 14, 2023

(65) Prior Publication Data

US 2025/0092750 A1 Mar. 20, 2025

(51) Int. Cl.
*E21B 31/00* (2006.01)

(52) U.S. Cl.
CPC ..... *E21B 31/007* (2013.01)

(58) Field of Classification Search
CPC ..... E21B 31/007
See application file for complete search history.

(56) References Cited

U.S. PATENT DOCUMENTS 2,154,654 A 4/1939 Armentrout et al.
4,488,747 A * 12/1984 Austin ..... E21B 47/09 294/86.1
9,399,269 B1 7/2016 Zediker et al.
11,053,771 B2 7/2021 Carragher
2014/0190949 A1* 7/2014 Zediker ..... B23K 26/38 219/121.72
2021/0262306 A1* 8/2021 Batarseh ..... B08B 9/027
2023/0151707 A1 5/2023 Batarseh

OTHER PUBLICATIONS

International Search Report and Written Opinion in International Appln. No. PCT/US2024/046454, mailed on Nov. 6, 2024, 14 pages.

* cited by examiner

*Primary Examiner* — Tara Schimpf
*Assistant Examiner* — Nicholas D Wlodarski
(74) *Attorney, Agent, or Firm* — Fish & Richardson P.C.

(57) ABSTRACT

A downhole fishing tool for retrieving an object from a wellbore includes a main body assembly configured to be positioned in the wellbore, a cladding material disposed on an edge of a downhole end of the main body, and a lens configured to direct a laser beam along the cladding material when the cladding material is in contact with the object, thereby welding the fishing tool to the object such that, when welded, pulling the tool in an uphole direction pulls the object along with the fishing tool.

16 Claims, 6 Drawing Sheets

LASER CLADDING FISHING TOOL

TECHNICAL FIELD

The present disclosure relates to subterranean wells, and more specifically, to removing objects from a subterranean well.

BACKGROUND

In subsurface well drilling and completion operations, it is not uncommon for an object (such as a tool, pipe, or fragment or component thereof) to fall into, get stuck, or unintentionally be left within a wellbore of a subterranean well. This fallen, stuck, or left object is known as a fish. The retrieval of such objects from a wellbore is referred to as fishing.

SUMMARY

Certain aspects of the subject matter herein can be implemented as a downhole fishing tool for retrieving an object from a wellbore. The tool includes a main body assembly configured to be positioned in the wellbore, a cladding material disposed on an edge of a downhole end of the main body, and a lens configured to direct a laser beam along the cladding material when the cladding material is in contact with the object, thereby welding the fishing tool to the object such that, when welded, pulling the tool in an uphole direction pulls the object along with the fishing tool.

Certain aspects of the subject matter herein can be implemented as a downhole fishing system for retrieving an object from a wellbore. The system includes a fishing tool. The fishing tool includes a main body assembly configured to be positioned in the wellbore, a cladding material disposed on an edge of a downhole end of the main body, and a lens configured to direct a laser beam along the cladding material when the cladding material is in contact with the object. The system also includes a conveyance configured to lower the fishing tool downhole and raise the tool uphole in the wellbore. The system is configured such that, when the cladding material is in contact with the object, laser light is directed by the lens along the cladding material, thereby welding the fishing tool to the object such that subsequently raising the fishing tool uphole, by the conveyance, pulls the object along with the tool.

Certain aspects of the subject matter herein can be implemented as a method for retrieving an object from a wellbore. The method includes lowering, by a conveyance assembly comprising an optical fiber, a fishing tool downhole within a wellbore. The fishing tool includes a main body, a cladding material disposed on an edge of a downhole portion of the tool, and a lens. The method includes contacting the cladding wire with the object and transmitting laser light through the optical fiber to the lens, thereby directing, through the lens, a laser beam along the cladding material, thereby welding the fishing tool to the object. The method further includes, after welding the fishing tool to the object, raising the fishing tool uphole by the conveyance assembly, thereby pulling the object along with the fishing tool.

DETAILED DESCRIPTION

In laser cladding, a laser beam is directly aimed at a cladding material (such as a cladding wire) disposed on surface. The heat generated by the beam melts and welds the cladding material to the surface. In some embodiments, a cladding tool or system can be configured such that a wire is disposed on the surface by a wire feeding system and the laser head subsequently travels along the wire, forming a continuous weld along the length of the wire. In some embodiments, a tool or system can be configured such that additional cladding layers can be disposed on the surface and/or the welded cladding material and the process repeated until the surface is adequately covered and/or a weld of desired thickness or strength is formed. A wire feeding system can include an internal purging system to direct excess cool down and direct gas or other by-products of the melting process way from the laser head and the surface.

In some embodiments of the present disclosure, a system, method, or apparatus includes or comprises a fishing tool that includes a lens assembly configured to direct a laser beam along a cladding wire of other cladding material when the cladding material is in contact with a fish, thereby welding the tool to the fish such that pulling the tool in an uphole direction pulls the fish uphole along with the fishing tool. In this way, heavier and/or larger fish can be retrieved than with conventional fishing tools, this increasing efficacy and safety of fishing operations.

Figure 1:
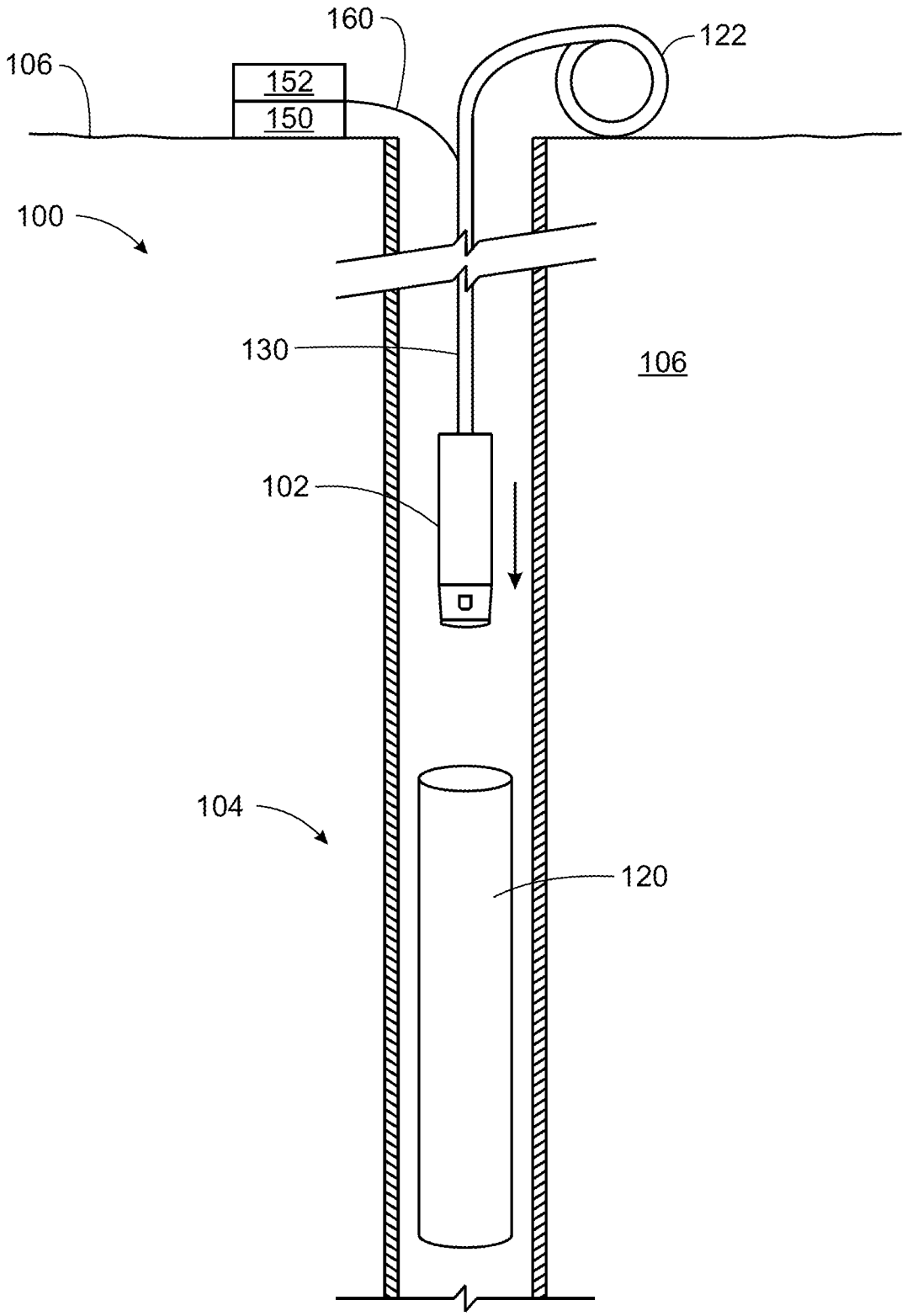
FIG. 1 is a schematic illustration of a fishing system comprising a laser cladding fishing tool disposed in a wellbore in accordance with an embodiment of the present disclosure.

FIG. 1 is a schematic illustration of a fishing system 100 in accordance with an embodiment of the present disclosure, comprising a laser cladding fishing tool 102 disposed in a wellbore 104 drilled from a surface 106 into a subterranean zone 107. Conveyance 130 can lower tool 102 in downhole direction (for example, towards a fish 120 or other downhole object within wellbore 104) and can raise tool 102 in an uphole direction. Conveyance 130 in the illustrated embodiment is a wireline supplied from a spool 122, but in other embodiments conveyance 130 could be coiled tubing or other suitable conveyance such as a downhole tractor. Wellbore 104 is illustrated as a vertical well but can be a horizontal, lateral, or other well or well portion or well segment. Wellbore 104 can be uncased or partially or fully cased.

As described in further detail below, tool 102 can include a lens assembly configured to direct a laser beam along cladding material when the cladding material is in contact with fish 120, thereby welding tool 102 to fish 120 such that subsequently pulling tool 102 by conveyance 130 in an uphole direction pulls fish 120 uphole along with tool 102. Also as described further below, tool 102 can include one or more sensors such as a camera or other optical sensor, acoustic sensor, and/or other sensors and/or mechanisms such as rotational heads or wire feed assemblies.

System 100 can further include a laser source module 150 which is configured to transmit laser light along optical fiber 160. Optical fiber 160 is connected to tool 102 and provides the laser light directed by the lens assembly. In some embodiments, optical fiber 160 can be integrated as a component of conveyance 130. System 100 can further include a control module 152 that can receive data the sensors and transmit control signals to wire feed assemblies, rotational head tool, and/or other mechanisms, via optical fiber 160 or another suitable wired or wireless connection. In some embodiments, laser source module 150 and control module 152 are positioned at a surface location. In some embodiments, some or all of the components of laser source module 150 or control module 152 can be positioned downhole during some or all of the fishing process. In some embodiments, the functions of source module 150 and control module 152 can be integrated into a combined laser source and control module.

Figure 2A:
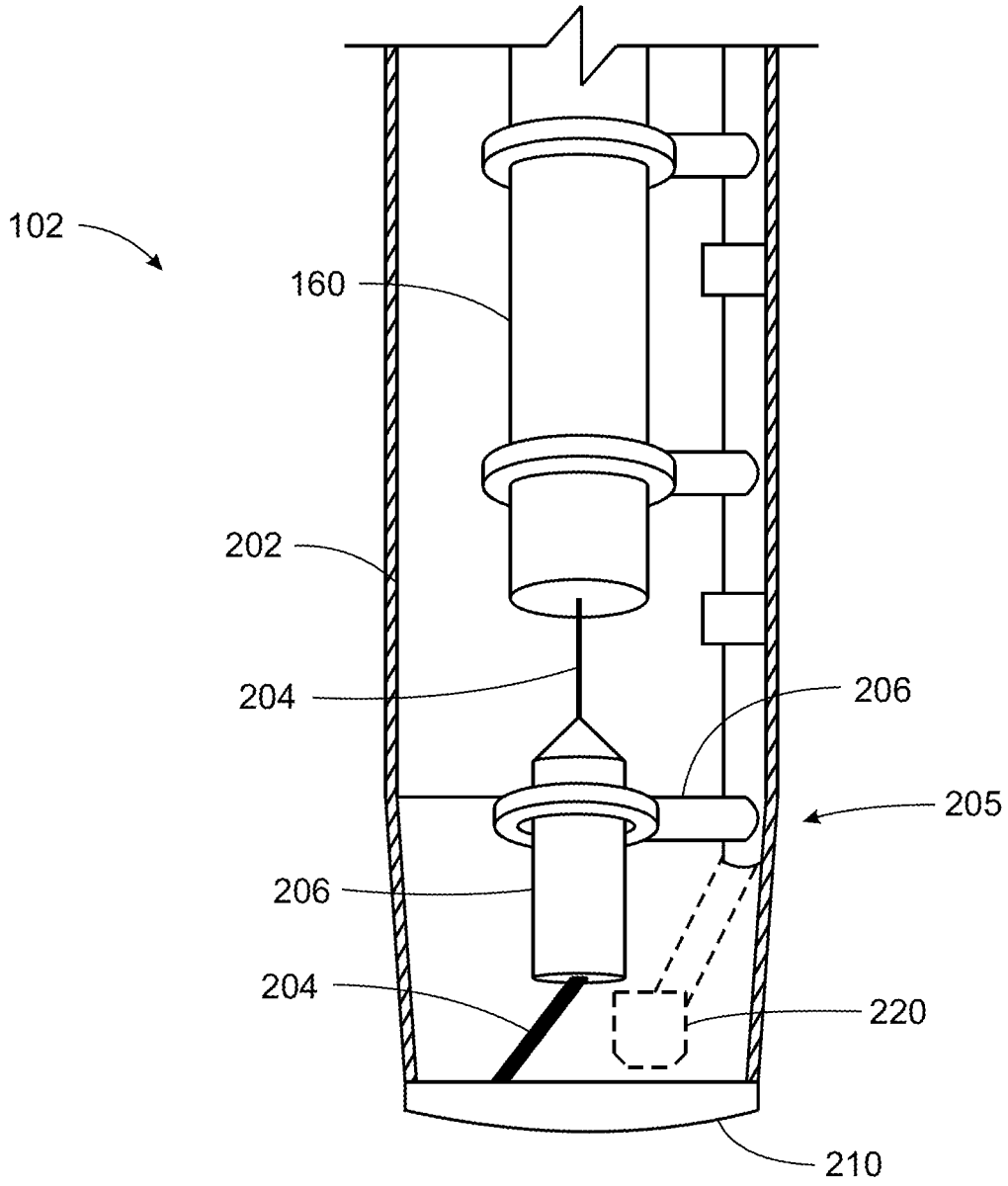
FIGS. 2A and 2B are a schematic illustrations of a laser cladding fishing tool in accordance with an embodiment of the present disclosure.
Figure 2B:
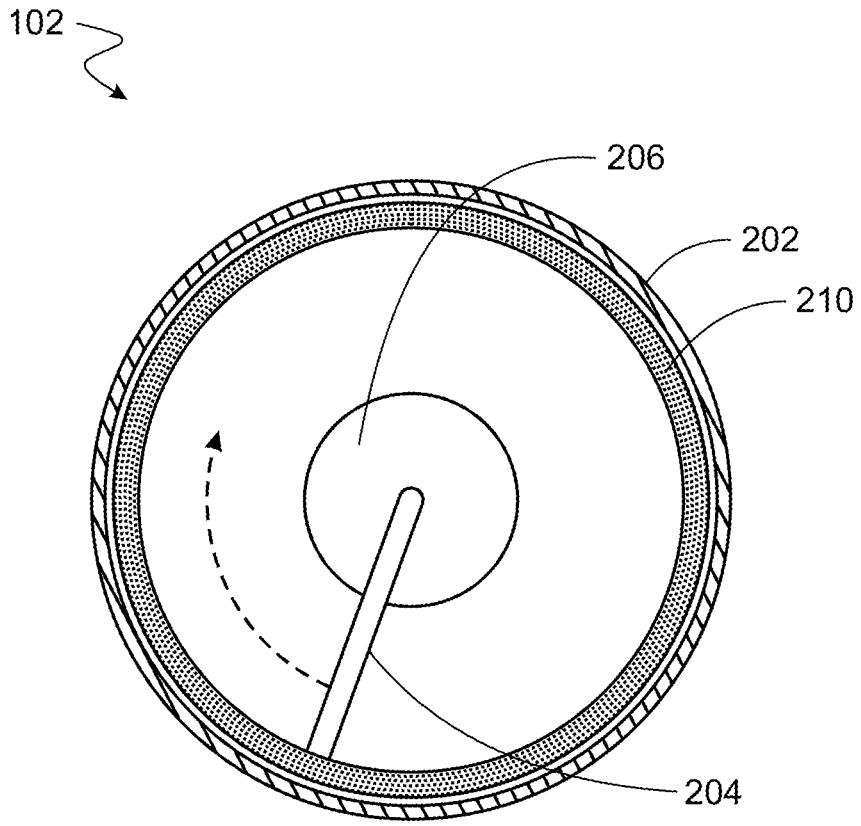

FIGS. 2A and 2B are a schematic illustrations showing further detail of laser cladding fishing tool 102 in accordance with an embodiment of the present disclosure. As shown in FIG. 2A, tool 102 includes a main body assembly 202 through which optical fiber 160 is disposed. Main body assembly 202 can be configured to protect the internal components of tool 102 from impacts with the wellbore and other hazardous downhole conditions. Laser beam 204 emitted from optical fiber 160 is directed to lens 206 of lens assembly 208. Lens 206 can control the shape, size, direction, and geometry of laser beam 204 so as to direct laser beam 204 to cladding 210 when cladding 210 is in contact with a surface of a fish, thereby melting the cladding and welding tool 102 to the fish. When so welded, uphole movement of tool 102 will pull the fish uphole along with the tool.

FIG. 2B illustrates the downhole end of main body assembly 202, viewed in an uphole direction from a position directly downhole of the tool. In the illustrated embodiment, as shown in FIG. 2B, main body assembly 202 is a tubular assembly and cladding 210 is disposed as a ring of cladding wire along the circumference of the edge of the downhole end. Cladding 210 can in some embodiments be comprised of a metallic material such as Inconel or another suitable austenitic nickel-chromium-based alloy.

In the illustrated embodiment, lens assembly 208 further includes a rotational head 205 configured to, when activated, impart rotation to lens 206, thereby directing laser beam 204 circumferentially along the ring of cladding 210, forming a continuous or semi-continuous layer of cladding along the circumference of the edge of the downhole end.

In the illustrated embodiment tool 102 includes one or more sensors 220 to enable the operator to determine the location, distance, size, shape, and/or orientation of fish 120 relative to tool 102 and the wellbore, as the tool is lowered downhole and/or during welding operations. Sensors 220 can in come embodiments include one or more acoustic sensors, one or more cameras, and/or other suitable sensors to locate the fish and identify the distance between the fish and the tool. In some embodiments, sensors 220 can include ultrasound imaging sensors that can provide visualization notwithstanding debris or other materials which may block conventional cameras. In some embodiments, sensors 220 can include thermal sensors to measure the temperature of the tool and the operational environment. Data from the sensors can also be used to validate the operation and the success of failure of the operation. In some embodiments, sensors 220 can include acoustic sensors (and/or transmitters) to measure body waves (such as primary (P) waves and secondary(S) waves) to determine the strength of the materials comprising the fish.

Figure 3:
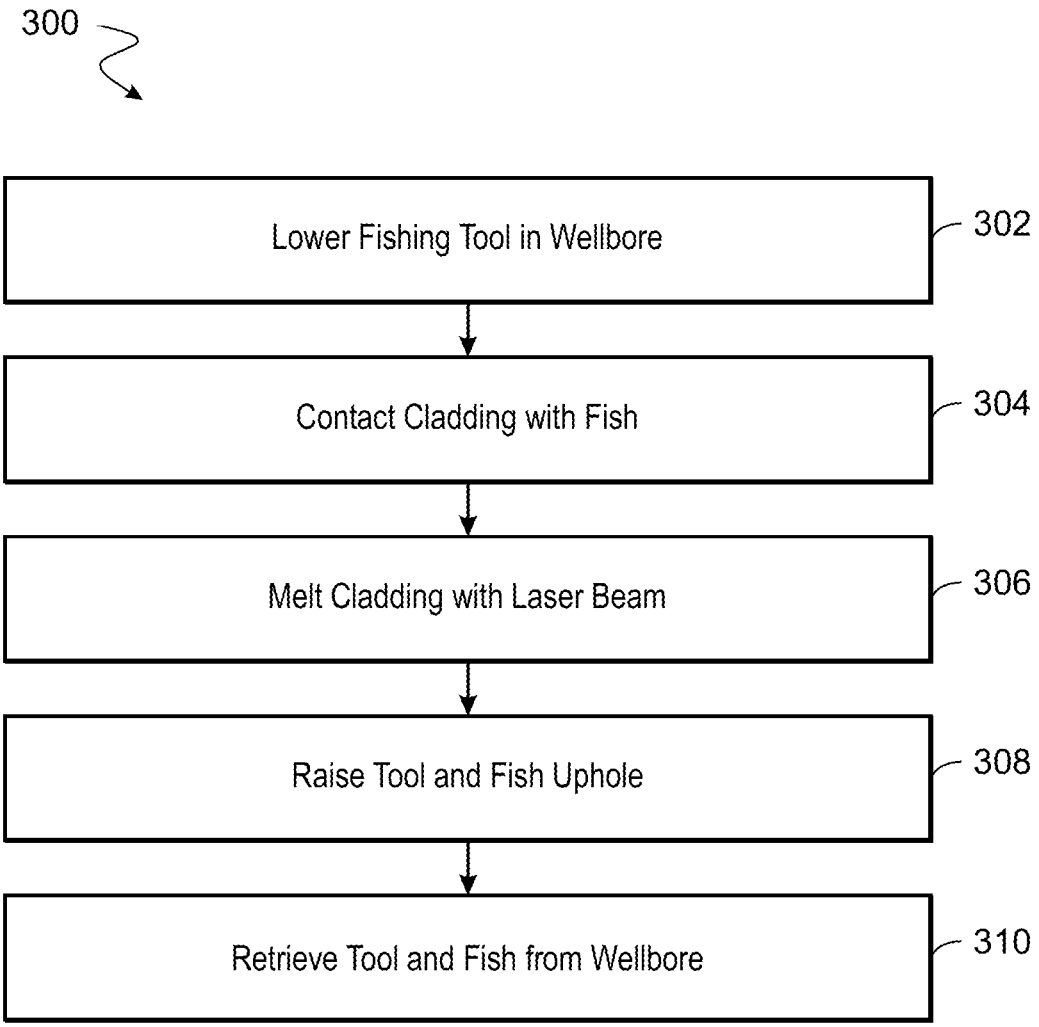
FIG. 3 process flow diagram of a method of operating a laser cladding fishing tool in accordance with an embodiment of the present disclosure.

FIG. 3 process flow diagram of a method of operating a laser cladding fishing tool in accordance with an embodiment of the present disclosure. The method of FIG. 3 is described in reference to the tool and system described in reference to FIGS. 1, 2A-2B, and 4A-4B; however, the method can be used with other suitable tools and systems.

Figure 4A:
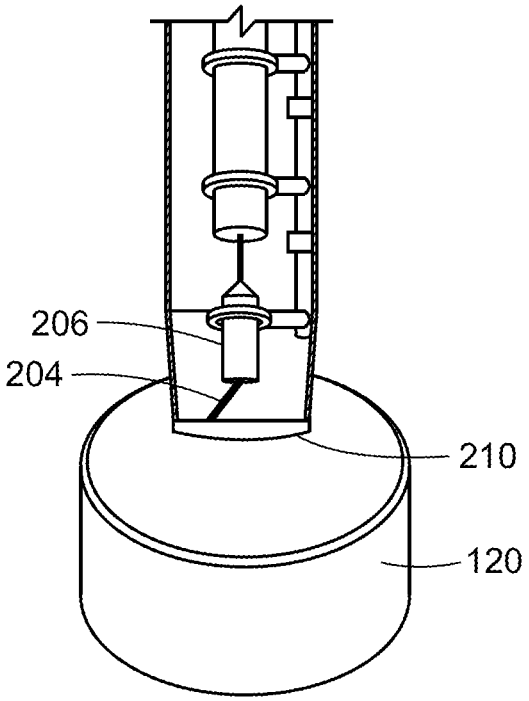
FIGS. 4A-4B are schematic illustrations of operation of a laser cladding fishing tool in accordance with an embodiment of the present disclosure.
Figure 4B:
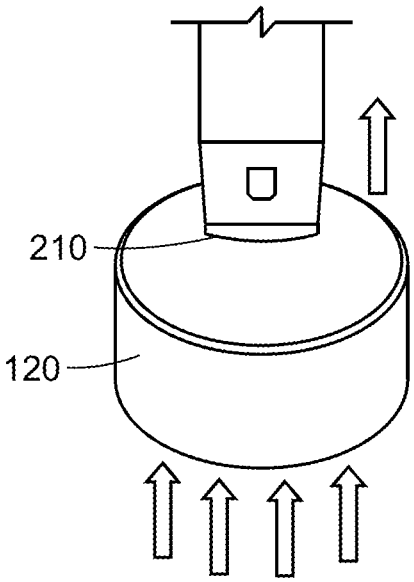

The method begins with step 302 in which laser cladding fishing tool 102 is lowered by a conveyance 130 downhole within wellbore 104. At step 304, cladding 210 disposed on tool 102 is contacted with the fish 120. At step 306, as shown in FIG. 4A, lens 206 directs laser beam 204 onto cladding 210, welding the tool 102 to the fish. At step 308, as shown in FIG. 4B, the fishing tool, with the fish welded to it, is pulled uphole, pulling the fish along with the tool. At step 310, the tool and fish can be retrieved from the wellbore.

Figure 5C:
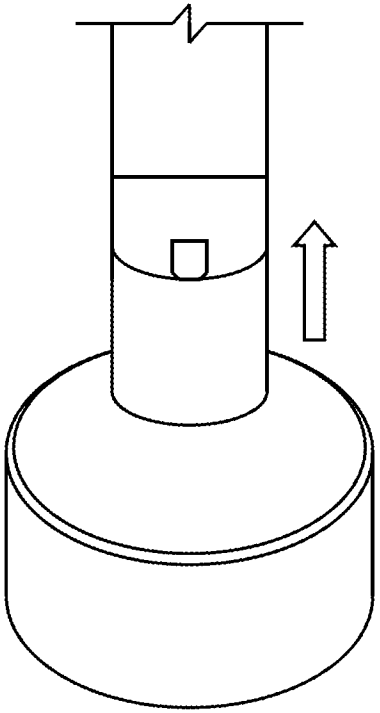
FIGS. 5A-5C are schematic illustrations of operation of a laser cladding fishing tool in accordance with an embodiment of the present disclosure.
Figure 5B:
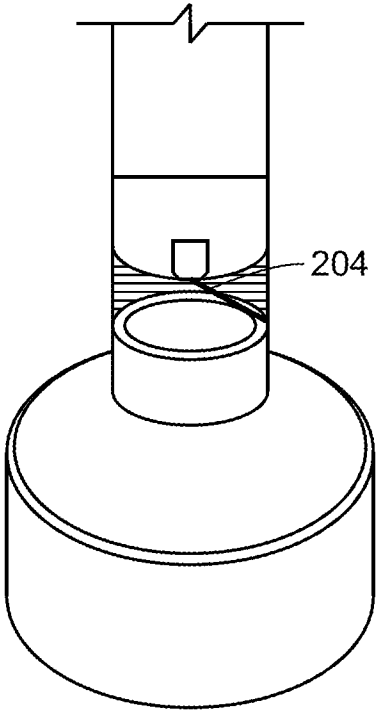
Figure 5A:
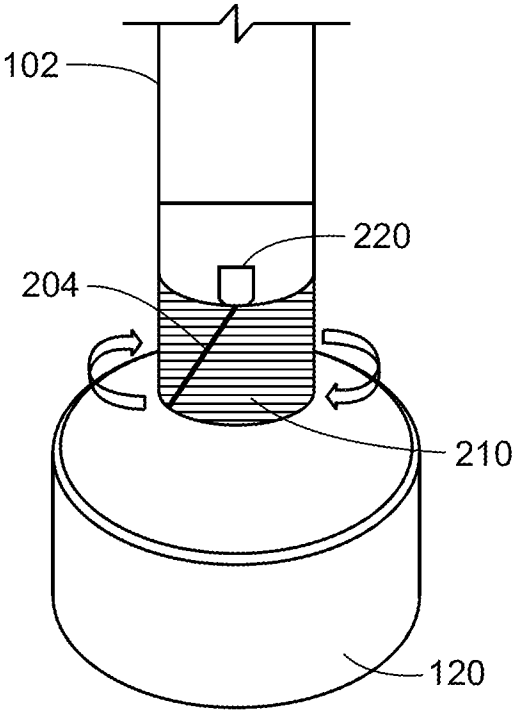

FIGS. 5A-5C illustrate an embodiment in which tool 102 includes cladding 210 in the form of multiple rings of cladding wire, to form a stronger cladding weld than might be achieved using only one cladding layer. As shown in FIG. 5A, tool 102 can be lowered in the wellbore to the target fish 120. Sensors 220 can include one or more acoustic sensors and/or cameras to measure the distance between the tool and the target as the tool approaches and contacts the target. This can aid the operator in determining when the tool has contact the fish. The rotational head can rotate laser beam 204 along the lower layer of cladding 210, welding the lower layer of cladding to fish 120. As shown in FIG. 5B, after completion of the weld of the lower cladding layer, the tool then can be adjusted such that laser beam 204 strikes the next layer (ring) of cladding 210 just above the lower layer, again rotating along that next layer to weld the next layer to the lower layer. This sequence can be repeated until all the layers of cladding are welded together, at which point (as shown in FIG. 5C) the tool can be pulled to the surface along with the fish 120. At the surface, the tool can be separated from the fish.

The term "uphole" as used herein means in the direction along a wellbore from its distal end towards the surface, and "downhole" as used herein means the direction along a wellbore from the surface towards its distal end. A downhole location means a location along a wellbore downhole of the surface.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described as acting in certain combinations and even initially claimed as such, one or more features from a claimed combination can in some cases be excised from the combination, and the claimed combination may be directed to a sub-combination or variation of a sub-combination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In a first aspect, a downhole fishing tool for retrieving an object from a wellbore is provided. The tool includes a main body assembly configured to be positioned in the wellbore, a cladding material disposed on an edge of a downhole end of the main body, and a lens configured to direct a laser beam along the cladding material when the cladding material is in contact with the object, thereby welding the fishing tool to the object such that, when welded, pulling the tool in an uphole direction pulls the object along with the fishing tool.

In a second aspect according to the first aspect, the downhole portion is a tubular assembly, the cladding material is disposed as a ring of cladding wire along the circumference of the edge of the downhole portion. The lens is disposed within the tubular assembly, and the fishing tool is configured such that directing the laser beam along the ring of cladding wire includes directing the laser beam circumferentially along the ring of cladding wire.

In a third aspect according to the first aspect or the second aspect, directing the laser beam circumferentially along the ring of cladding wire includes rotating the lens.

In a fourth aspect according to any of the first aspect to the third aspect, the tool further includes one or more sensors configured to determine physical parameters indicative of the location and orientation of the object in relation to the fishing tool.

In a fifth aspect according to any of the first aspect to the fourth aspect, the one or more sensors includes an acoustic sensor.

In a sixth aspect, a downhole fishing system for retrieving an object from a wellbore is provided. The system includes a fishing tool. The fishing tool includes a main body assembly configured to be positioned in the wellbore, a cladding material disposed on an edge of a downhole end of the main body, and a lens configured to direct a laser beam along the cladding material when the cladding material is in contact with the object. The system also includes a conveyance configured to lower the fishing tool downhole and raise the tool uphole in the wellbore. The system is configured such that, when the cladding material is in contact with the object, laser light is directed by the lens along the cladding material, thereby welding the fishing tool to the object such that subsequently raising the fishing tool uphole, by the conveyance, pulls the object along with the tool.

In an seventh aspect according to the sixth aspect, the downhole portion is a tubular assembly, the cladding material is disposed as a ring of cladding wire along the circumference of the edge of the downhole portion, the lens is disposed within the tubular assembly, and the fishing tool is configured such that directing the laser beam along the ring of cladding wire includes directing the laser beam circumferentially along the ring of cladding wire.

In an eighth aspect according to the sixth or the seventh aspect, the laser beam is directed circumferentially along the ring of cladding wire includes rotating the lens.

In a ninth aspect according to any of the sixth to the eighth aspect, the fishing tool further includes one or more sensors configured to determine physical parameters indicative of the location and orientation of the object in relation to the fishing tool.

In a tenth aspect according to any of the sixth to the ninth aspect, the one or more sensors includes an acoustic sensor.

In an eleventh aspect according to any of the sixth to the tenth aspect, the one or more sensors includes a camera.

In a twelfth aspect according to any of the sixth to the eleventh aspect, the conveyance includes an optical fiber.

In a thirteenth aspect, a method for retrieving an object from a wellbore includes lowering, by a conveyance assembly including an optical fiber, a fishing tool downhole within a wellbore. The fishing tool includes a main body, a cladding material disposed on an edge of a downhole portion of the tool, and a lens. The method includes contacting the cladding wire with the object and transmitting laser light through the optical fiber to the lens, thereby directing, through the lens, a laser beam along the cladding material, thereby welding the fishing tool to the object. The method further includes, after welding the fishing tool to the object, raising the fishing tool uphole by the conveyance assembly, thereby pulling the object along with the fishing tool.

In a fourteenth aspect according to the thirteenth aspect, the downhole portion is a tubular assembly, the lens is disposed within the tubular assembly, and the cladding material is disposed as a ring of cladding wire along the circumference of the edge of the downhole portion. The method further includes directing the laser beam along the ring of cladding wire includes directing the laser beam circumferentially along the ring of cladding wire.

In a fifteenth aspect according to the thirteenth or fourteenth aspect, directing the laser beam circumferentially along the ring of cladding wire includes rotating the lens.

In a sixteenth aspect according to any of the thirteenth to the fifteenth aspect, the fishing tool further includes further includes one or more sensors, and further including determining the location and orientation of the object in relation to the fishing tool based on data from the one or more sensors.

In a seventeenth aspect according to any of the thirteenth to the sixteenth aspect, the one or more sensors includes an acoustic sensor.

In an eighteenth aspect according to any of the thirteenth to the seventeenth aspect, the one or more sensors includes a camera.

In a nineteenth aspect according to any of the thirteenth to the eighteenth aspect, the conveyance assembly includes a wireline including the optical fiber.

In a twentieth aspect according to any of the thirteenth to the nineteenth aspect, the method of claim 15, wherein the ring of cladding wire includes a first ring of cladding wire and further including adjusting the laser beam to direct the laser beam along a second ring of cladding wire disposed alongside the first ring of cladding wire.

What is claimed is:

1. A downhole fishing tool for retrieving an object from a wellbore, the tool comprising:

a main body comprising a tubular assembly configured to be positioned in the wellbore; and a lens configured to direct a laser beam circumferentially along a first ring of cladding wire when the first ring is in contact with the object, thereby welding the first ring to the object, and subsequently to direct the laser beam circumferentially along a second ring of cladding wire disposed above the first ring, thereby welding the second ring together with the first ring and the tubular assembly such that, when the first ring and the second ring are so welded, pulling the tool in an uphole direction pulls the object along with the fishing tool.

2. The fishing tool of claim 1, wherein directing the laser beam circumferentially along the first ring and second ring comprises rotating the lens.

3. The fishing tool of claim 1, further comprising one or more sensors configured to determine physical parameters indicative of the location and orientation of the object in relation to the fishing tool.

4. The fishing tool of claim 3, wherein the one or more sensors comprises an acoustic sensor.

5. A downhole fishing system for retrieving an object from a wellbore, the system comprising:

a fishing tool comprising:

a main body comprising a tubular assembly configured to be positioned in the wellbore;

and a lens configured to direct a laser beam circumferentially along a first ring of cladding wire when the first ring is in contact with the object, thereby welding the first ring to the object, and subsequently to direct the laser beam circumferentially along a second ring of cladding wire disposed above the first ring, thereby welding the second ring and the first ring together with the tubular assembly; and a conveyance configured to lower the fishing tool downhole and raise the tool uphole in the wellbore and configured such that, with the first ring and the second ring are so welded, subsequently raising the fishing tool uphole, by the conveyance, pulls the object along with the tool.

6. The system of claim 1, wherein directing the laser beam circumferentially along the first ring and the second ring comprises rotating the lens.

7. The system of claim 5, wherein the fishing tool further comprises one or more sensors configured to determine physical parameters indicative of the location and orientation of the object in relation to the fishing tool.

8. The system of claim 7, wherein the one or more sensors comprises an acoustic sensor.

9. The system of claim 7, wherein the one or more sensors comprises a camera.

10. The system of claim 7, wherein the conveyance comprises an optical fiber.

11. A method for retrieving an object from a wellbore, the method comprising:

lowering, by a conveyance assembly comprising an optical fiber, a fishing tool downhole within a wellbore, the fishing tool comprising:

a main body comprising a tubular assembly;

and a lens configured to direct a laser beam circumferentially about a downhole end of the tubular assembly;

contacting a first ring of cladding wire with the object;

directing, through the lens, a laser beam along the first ring, thereby welding the first ring to the object;

disposing a second ring of cladding wire above the first ring;

direct the laser beam circumferentially along the second ring of cladding wire, thereby welding the second ring and the first ring together with the tubular assembly; and with the first ring and the second ring so welded, raising the fishing tool uphole by the conveyance assembly, thereby pulling the object along with the fishing tool.

12. The method of claim 11, wherein directing the laser beam circumferentially along the first ring and the second ring comprises rotating the lens.

13. The method of claim 11, the fishing tool further comprises further comprises one or more sensors, and further comprising determining the location and orientation of the object in relation to the fishing tool based on data from the one or more sensors.

14. The method of claim 13, wherein the one or more sensors comprises an acoustic sensor.

15. The method of claim 13, wherein the one or more sensors comprises a camera.

16. The method of claim 11, wherein the conveyance assembly comprises a wireline comprising the optical fiber.

* * * * *